US005860285A

United States Patent [19]

Tulpule

[11] Patent Number: 5,860,285

[45] Date of Patent: Jan. 19, 1999

[54] SYSTEM FOR MONITORING OUTDOOR HEAT EXCHANGER COIL

[75] Inventor: Sharayu Tulpule, Farmington, Conn.

[73] Assignee: Carrier Corporation, Syracuse, N.Y.

[21] Appl. No.: 869,533

[22] Filed: Jun. 6, 1997

[51] Int. Cl.[6] ..... F25B 49/02

[52] U.S. Cl. ..... 62/127; 165/11.1; 62/129

[58] Field of Search ..... 62/125, 126, 127, 62/129; 165/11.1, 11.2; 340/607, 608; 236/94; 702/33, 34; 706/15, 20, 23, 25, 38, 41

[56] References Cited

U.S. PATENT DOCUMENTS 4,660,386 4/1987 Hansen et al. ..... 62/126
5,260,526 11/1993 Sirag ..... 187/127
5,333,240 7/1994 Matsumoto et al. ..... 395/23
5,372,015 12/1994 Suzuki et al. ..... 706/23 X
5,442,926 8/1995 Kawei et al. ..... 62/126 X
5,528,908 6/1996 Bahel et al. ..... 62/129 X
5,539,382 7/1996 Duff et al. ..... 62/129 X
5,539,385 7/1996 Duff et al. ..... 62/129 X

*Primary Examiner*—Harry B. Tanner

[57] ABSTRACT

A system for monitoring an outdoor heat exchange coil of a heating or cooling system includes a neural network for computing the status of the coil. The neural network is trained during a development mode to learn certain characteristics of the heating or cooling system that will allow it to accurately compute the status of the coil. The thus trained neural network timely computes the status of the outdoor heat exchange coil during a run time mode of operation. Information as to the status of the coil is made available for assessment during the run time mode of operation.

32 Claims, 5 Drawing Sheets

SYSTEM FOR MONITORING OUTDOOR HEAT EXCHANGER COIL

BACKGROUND OF THE INVENTION

This invention relates to monitoring the operation of a heating or cooling system, and more specifically to monitoring the condition of an outdoor heat exchanger coil for such systems.

Many heating and/or cooling systems employ heat exchanger coils located outside of the buildings that are to be heated or cooled by these particular systems. These outdoor heat exchanger coils are typically exposed to a variety of severe conditions. These conditions may include exposure to airborne contaminants that may result in mineral deposits forming on the surface of the coils. The outdoor heat exchanger coils may also be placed at ground level so as to thereby be exposed to wind blown dust or the splashing of dirt during heavy rain storms. The accumulation of dust, dirt, mineral deposits and other contaminants on the surface of the outdoor heat exchanger coil will ultimately produce an insulating effect on the coil. This will reduce the heat heat transfer efficiency of the coil, which will in turn impact the capacity of the heating or cooling system to accomplish its respective function.

It is important to detect any significant degradation of the surface of the outdoor heat exchanger coil before its heat exchange performance is adversely affected. This is normally accomplished by a visual inspection of the outdoor coil that is usually performed by a service person, who may be maintaining or servicing the heating or cooling system. This servicing may not always occur in a timely fashion.

SUMMARY OF THE INVENTION

It is an object of this invention to detect an early degradation of the surface of an outdoor heat exchanger coil of a heating or cooling system of a heating or cooling system without having to visually inspect the coil.

It is another object of this invention to detect any early degradation in the surface of the outdoor heat exchanger coil of a heating or cooling system before any significant degradation in the performance of the outdoor heat exchanger coil occurred.

The above and other objects are achieved by providing a monitoring system with the capability of first performing a collective analysis of a number of conditions within a heating or cooling system that will be adversely impacted by a degraded heat exchanger coil in that system. The monitoring system utilizes a neural network to learn how these conditions collectively indicate a tarnished or dirty heat exchanger coil which may need to be cleaned. This is accomplished by subjecting the heating or cooling system, having the outdoor heat exchanger coil to a variety of ambient and building load conditions. The level of cleanliness of the outdoor heat exchanger coil is also varied during the course of subjecting the heating or cooling system to the ambient and building load conditions. Data produced by sensors within the heating or cooling system as well as certain control information is collected for a variety of ambient and building load conditions. Sets of data are collected for noted levels of cleanliness of the outdoor coil.

The collected data is applied to the neural network within the monitoring system in a manner which allows the neural network to learn to accurately compute the cleanliness level of the outdoor coil for a variety of ambient and building load conditions. The neural network preferably consists of a plurality of input nodes each receiving one piece of data from a collected set of data. Each input node is connected via weighted connections to hidden nodes within the neural network. These plurality of hidden nodes are furthermore connected via weighted connections to at least one output node which produces an indication as to the level of cleanliness of the outdoor heat exchanger coil. The various weighted connections are continuously adjusted during repetitious application of the data until such time as the output node produces a level of cleanliness that converges to known values of outdoor coil cleanliness for the provided data. The finally adjusted weighted connections are stored for use by the monitoring system during a run time mode of operation.

The monitoring system uses the neural network during a run time mode of operation to analyze real time data being provided by a functioning heating or cooling system. The real time data is applied to the neural network and is processed through the nodes having the various weighted connections so that an indication as to the cleanliness level of the outdoor coil can be continuously computed. The continuous computations of the cleanliness level of the outdoor coil are preferably stored and averaged over a predetermined period of time. The resulting average cleanliness level is displayed as an output of the monitoring system. The displayed cleanliness level can be used to indicate whether or not the heating or cooling system should be shut down for appropriate servicing due to the displayed level of outdoor coil cleanliness.

In a preferred embodiment of the invention, the cleanliness level of the outdoor coil of a chiller is monitored. The monitoring system receives data from eight different sources within the chiller during the run time mode of operation. The monitoring system also receives the commands from the chiller's controller to sets of fans associated with condensers containing outdoor heat exchanger coils. The source data plus chiller controller commands to the sets of fans are collectively analyzed by the neural network within the monitoring system so as to produce a level of cleanliness for at least one outdoor heat exchanger coil of a condenser within the chiller.

BRIEF DESCRIPTION OF THE DRAWINGS

The invention will become more apparent by reading a detailed description thereof in conjunction with the following drawings, wherein.

DESCRIPTION OF THE PREFERRED EMBODIMENT

Figure 1:
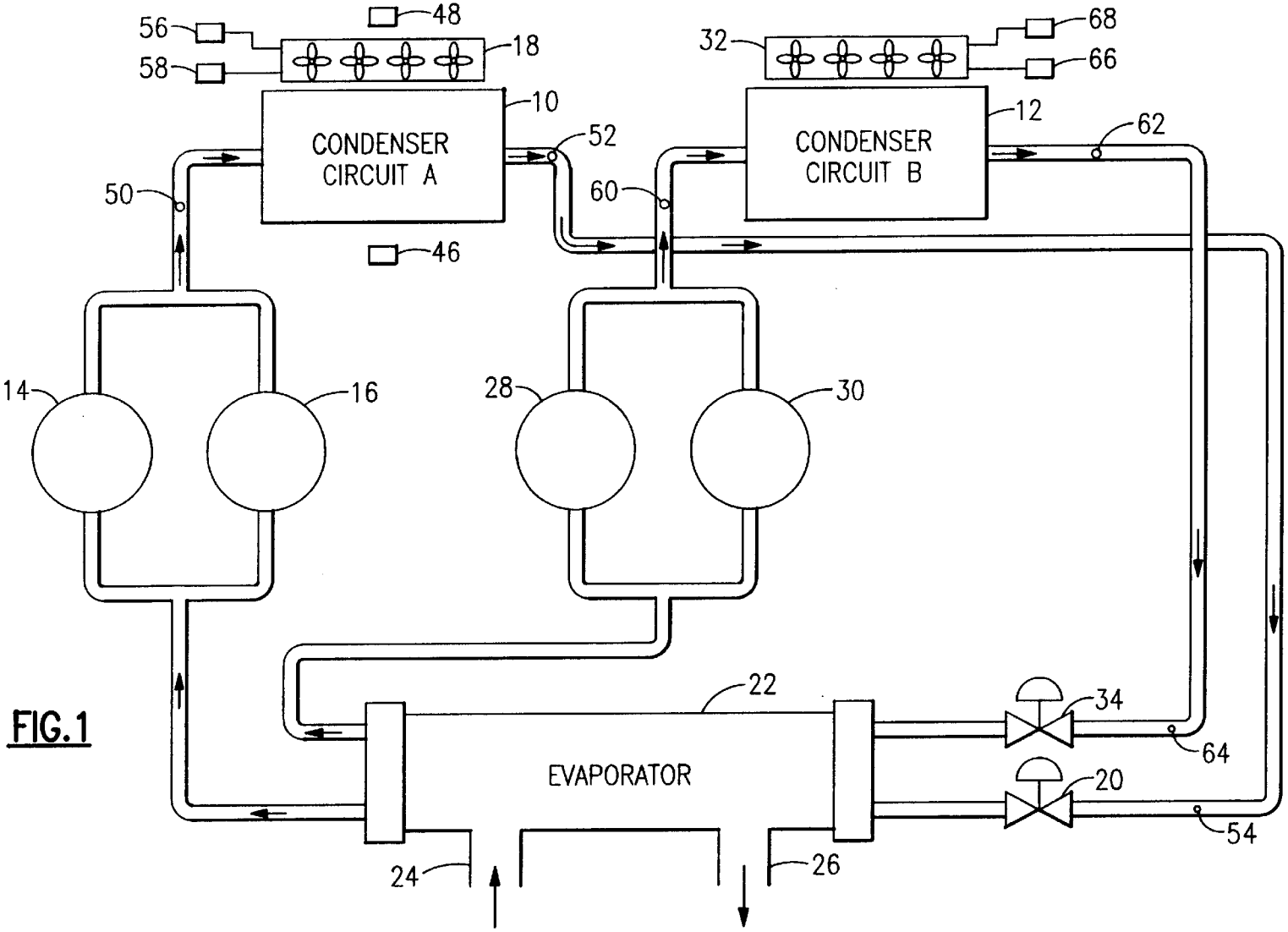
FIG. 1 is a schematic diagram of a chiller including two separate condensers having outdoor heat exchanger coils.

Referring to FIG. 1, a chiller is seen to include two separate refrigeration circuits "A" and "B", each of which has a respective condenser 10 or 12. In order to produce cold water, the refrigerant is processed through chiller components in each respective refrigeration circuit. In this regard, refrigerant gas is compressed to high pressure and high temperature in a pair of compressors 14 and 16 in circuit A. The refrigerant is allowed to condense to liquid giving off heat to air blowing through the condenser 10 by virtue of a set of fans 18. The condenser preferably allows the liquid refrigerant to cool further to become subcooled liquid. This subcooled liquid passes through an expansion valve 20 before entering an evaporator 22 commonly shared with refrigeration circuit B. The refrigerant evaporates in the evaporator 22 absorbing heat from water circulating through the evaporator 22 from an input 24 to an output 26. The water in the evaporator gives off heat to the refrigerant and becomes cold. The cold or chilled water ultimately provides cooling to a building. The cooling of the building is often accomplished by a further heat exchanger (not shown) wherein circulating air gives off heat to the chilled or cold water. It is to be noted that refrigerant is also compressed to high pressure and temperature through a set of compressors 28 and 30 in refrigeration circuit B. This refrigerant is thereafter condensed to liquid in condenser 12 having a set of fans 32 which cause air to flow through the condenser. The refrigerant leaving condenser 12 passes through expansion valve 34 before entering the evaporator 22.

Figure 2:
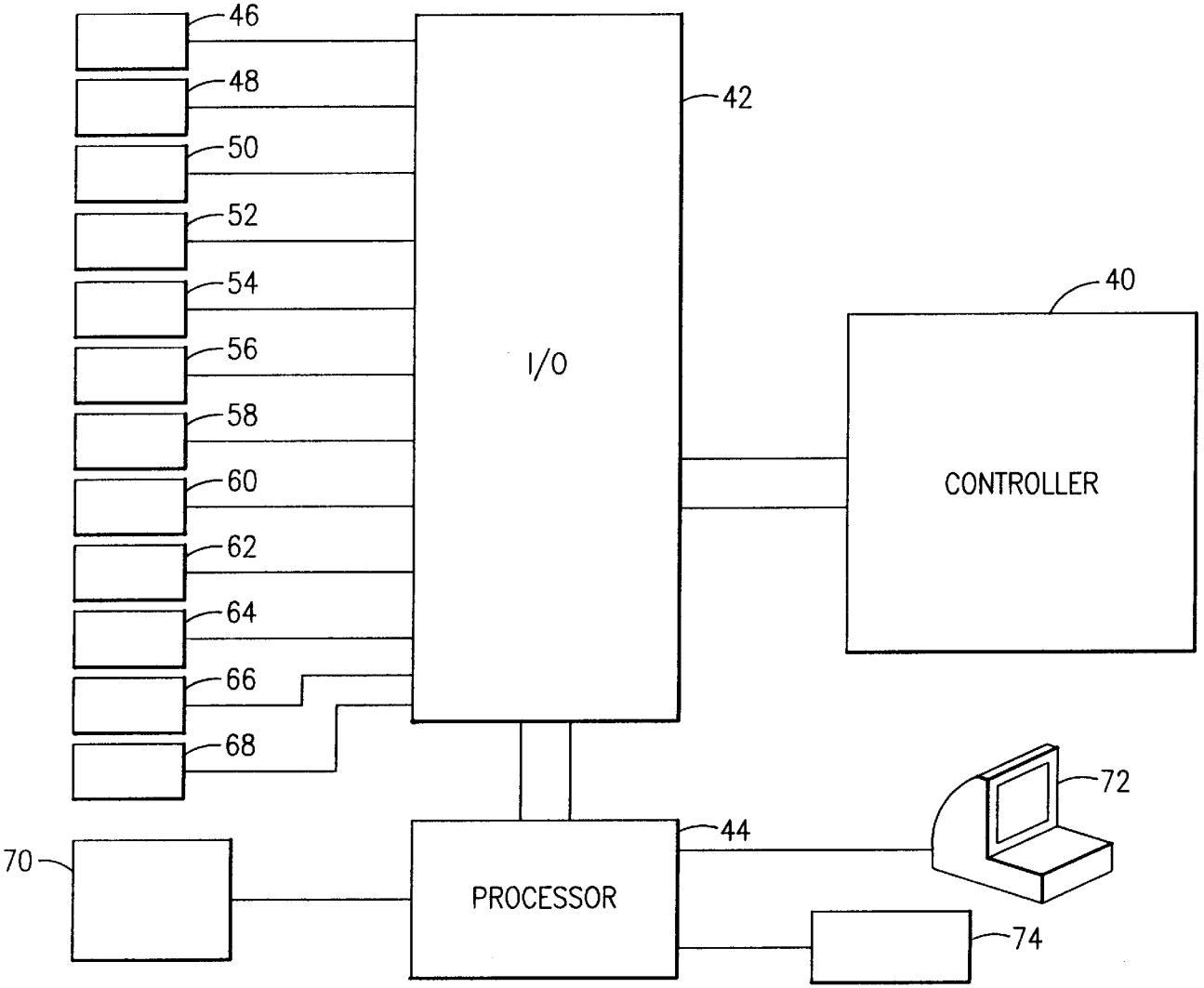
FIG. 2 is a block diagram of a controller for the chiller of FIG. 1 plus a processor containing neural-network software for computing the level of cleanliness of one outdoor heat exchanger coil of one of the condenser of the chiller.

Referring to FIG. 2, a controller 40 controls the expansion valves 20 and 22 as well as the fan sets 18 and 32 governing the amount of air circulating through the condensers 10 and 12. The controller turns the compressors 14, 16, 28 and 30 on and off in order to achieve certain required cooling of the water flowing through the evaporator 22. A set of sensors located at appropriate points within the chiller of FIG. 1 provide information to the controller 40 through an I/O bus 42. Eight of these sensors are also used to provide information to a processor 44 associated with the I/O bus 42. In particular, a sensor 46 senses the temperature of the air entering the condenser 10 within refrigeration circuit A. A sensor 48 senses the temperature of the air leaving this condenser. These temperatures will be referred to hereinafter as "CEAT" for condenser entering air temperature, and "CLAT" for condenser leaving air temperature. A sensor 50 measures the temperature of the refrigerant entering condenser 10 whereas a sensor 52 measures the temperature of the refrigerant leaving condenser 10. These temperatures will be referred to hereinafter as "COND_E_T_A" for the condenser entering refrigerant temperature sensed by sensor 50 and "COND_L_T_A" for the condenser leaving refrigerant temperature sensed by sensor 52. It is to be noted that each of the aforementioned temperatures are also indicated as being from refrigerant circuit A. The subcooled temperature of the refrigerant in circuit A is sensed by a sensor 54 located above expansion valve 20. This particular temperature will be hereinafter referred to "SUBCA". In addition to receiving the sensed conditions produced by sensors 46 through 54, the processor 40 also receives the commanded statuses from the controller 40 for fan relay switches 56 and 58 associated with the set of fans 18 for the condenser 10. These commanded statuses will be hereinafter referred to as "fan switch status "A1"" and "fan switch status "A2"". It is to be appreciated that these statuses will collectively indicate the number of fans in fan set $b_o$ that are on or off.

The processor 44 also receives certain values from refrigeration circuit B. In this regard, a sensor 60 measures the temperature of the refrigerant entering condenser 12 whereas a sensor 62 measures the temperature of the refrigerant leaving the condenser 12. These temperatures will be hereinafter referred to as "COND_E_T_B" for the condenser entering refrigerant temperature and "COND_L_T_B" for condenser leaving refrigerant temperature. The processor 40 also receives a subcooled refrigerant temperature for the refrigerant in circuit B as measured by a sensor 64 located above the expansion valve 34. This particular temperature will be hereinafter referred to as "SUBCB". It is finally to be noted that the processor receives the commanded statuses from the controller 40 for fan relay switches 66 and 68 associated with the set of fans 32. These commanded statuses will be hereinafter referred to as "B1" and "B2".

The processor 44 is seen to be connected to a display 70 in FIG. 2 which may be part of a control panel for the overall chiller. The display is used by the processor 44 to provide coil cleanliness information for the outdoor heat exchanger coil of condenser 10. This displayed information would be available to anyone viewing the control panel of the chiller of FIG. 1.

The processor 44 is also directly connected to a keyboard entry device 72 and to a hard disc storage device 74. The keyboard entry device may be used to enter training data to the processor for storage in the storage device 74. As will be explained hereinafter, training data may also be directly downloaded from the controller 40 to the processor for storage in the storage device 74. This training data is thereafter processed by neural-network software residing within the processor 44 during a development mode of operation.

Figure 3:
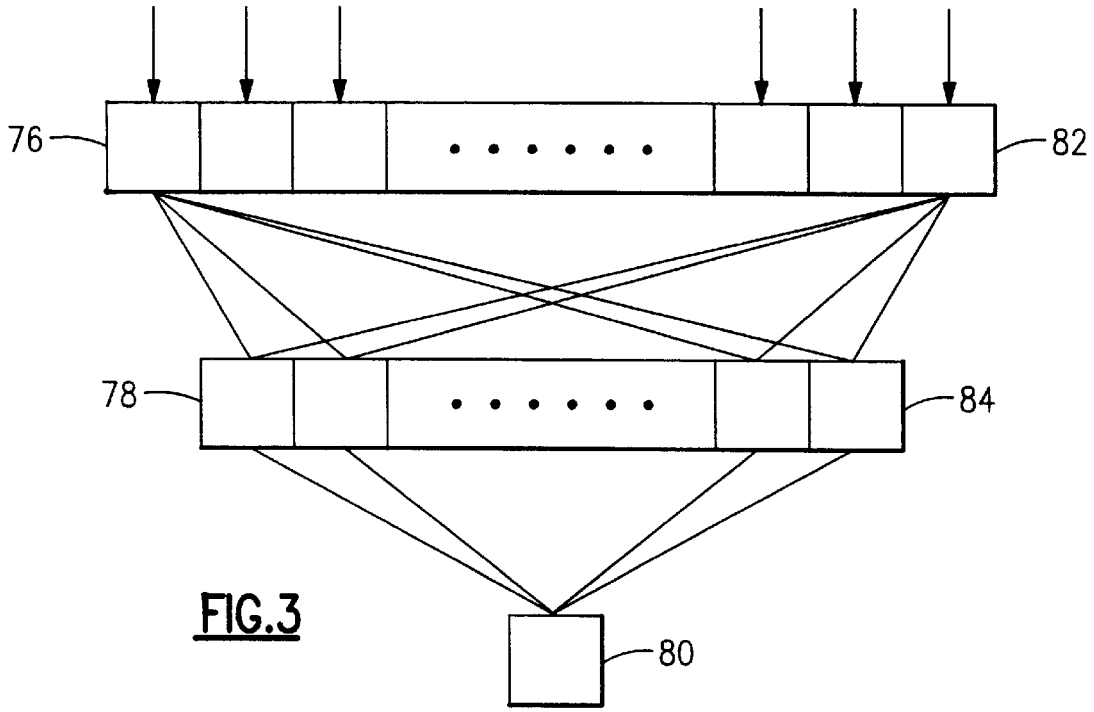
FIG. 3 is a diagram depicting the connections between nodes in various layers of the neural-network software.

The neural-network software executed by the processor 44 is a massively parallel, dynamic system of interconnected nodes such as 76, 78 and 80 illustrated in FIG. 3. The nodes are organized into layers such as an input layer 82, a hidden layer 84, and an output layer consisting of the one output node 80. The input layer preferably includes twelve nodes such as 70, each of which receives a sensed or noted value from the chiller. The hidden layer preferably includes ten nodes. The nodes have full or random connections between the successive layers. These connections have weighted values that are defined during the development mode of operation.

Figure 4:
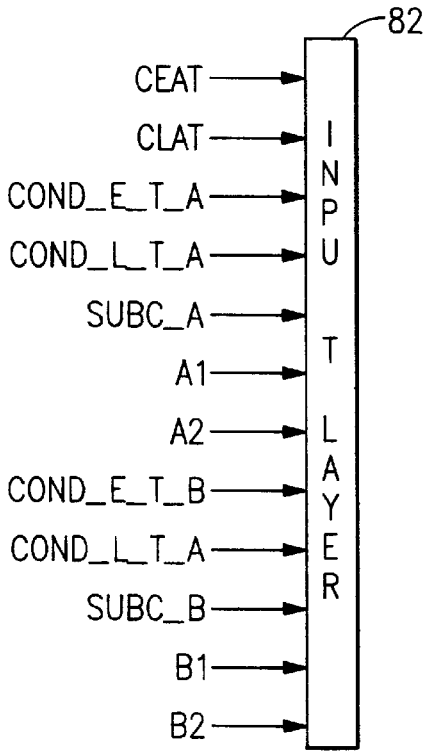
FIG. 4 is a block diagram depicting certain data applied to the first layer of nodes in FIG. 3.

Referring to FIG. 4, the various inputs to the input layer 82 are shown. These inputs are the eight sensor measurements from sensors 46, 48, 50, 52, 54, 60, 62 and 64. These inputs also include the status levels of the relay switches, 56, 58, 66 and 68. Each of these inputs becomes a value of one of the input nodes such as input node 76.

Figure 5:
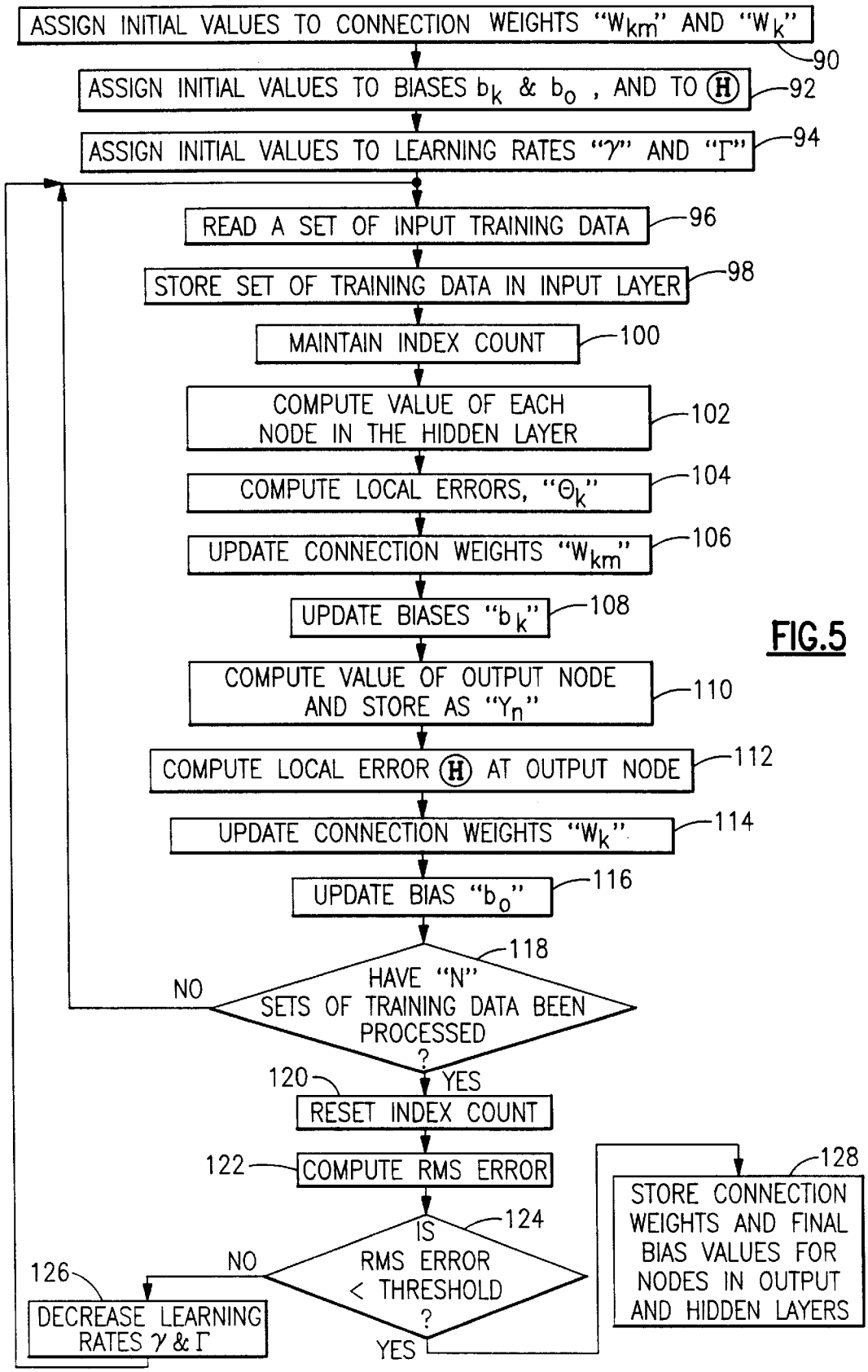
FIG. 5 is a flow chart of a neural-network process executed by the processor of FIG. 2 during a development mode of operation.

Referring now to FIG. 5, a flow chart of the processor 44 executing neural network training software during the development mode of operation is illustrated. The processor begins by assigning initial values to the connection weights "$w_{km}$" and "$w_k$" in a step 90. The processor proceeds in a step 92 to assign initial values to biases "$b_k$" and "$b_o$". These biases are used in computing respective output values of nodes in the hidden layer and the output node. The initial values for these biases are fractional numbers between zero and one. The processor also assigns an initial value to a variable $\Theta$ in step 92. This initial value is preferably a decimal value that is closer to zero than to one. Further values will be computed for $b_k$, $b_o$ and $\Theta$ during the development mode. The processor next proceeds to a step 94 and assigns initial values to learning rates $\gamma$ and $\Gamma$. These learning rates are used respectively in hidden layer and output node computations as will be explained hereinafter. The initial values for the learning rates are decimal numbers greater than zero and less than one.

The processor will proceed to a step 96 and read a set of input training data from the storage device 74. The set of input training data will consist of the eight values previously obtained from each of the eight sensors 46, 48, 50, 52, 54, 60, 62 and 64 as well as the commanded statuses from the controller for the relay switches 56, 58, 66, and 68. This set of input training data will have been provided to the processor 44 when the chiller was subjected to a particular ambient and a particular load condition wherein the outdoor coil of the condenser 10 has a particular level of cleanliness. In this regard, the outdoor coil of the condenser 10 will preferably have been subjected to adverse outdoor conditions for a considerable period of time so as to thereby tarnish or dirty the surface of the coil. In the preferred embodiment, such a condenser coil had been exposed to adverse outdoor conditions for a period of five years. It is to be appreciated that the chiller with the thus tarnished or dirty coil will have been subjected to a considerable number of other ambient and load conditions. To subject the chiller to different load conditions, hot water may be circulated through the evaporator 22 so as to simulate the various building load conditions. The chiller will also have been subjected to a considerable number of ambient and load conditions for a completely clean outdoor coil in the condenser 10. In this regard, the outdoor coil that had been previously subjected to severe outdoor conditions over an extended period of time could be cleaned to a state that it was in before being subjected to the adverse outdoor conditions. On the other hand, a completely new coil could be used in condenser 10. The chiller with the thus reconditioned coil or new coil would be subjected to the aforementioned ambient and load conditions.

The processor 44 will preferably have received values from the various sensors and values of the commanded relay switch statuses from the controller 40 for each noted set of training data. In this regard, the controller 40 preferably reads values of eight the sensors 46, 48, 50, 52, 54, 62 and 64 and the status of the relay switches as the chiller is being subjected to the particular ambient and building load conditions for a particular level of cleanliness of the outdoor coil for the condenser 10. The controller 40 also has a record of the values of the relay switch status commands that it issued to the respective relay switches when the sensors are read. These twelve values will have been stored in the storage device 74 as the twelve respective values of a set of training data. The processor will also have received a typed in input of the known cleanliness level of the outdoor coil from the keyboard device 72. The cleanliness level in the preferred embodiment was "0.1" for a dirty or tarnished coil and "0.9" for a completely reconditioned or new coil. This cleanliness level is preferably stored in conjunction with the set of training data so that it may be accessed when the particular set of training data is being processed.

The processor will proceed from step 96 to a step 98 and store the twelve respective values of the set of training data read in step 96. These values will be stored as values "$x_m$" where "m" equals one through twelve and identifies each one of the respective twelve nodes of the input layer 82. An indexed count of the number of sets of training data that have been read and stored will be maintained by the processor in a step 100.

The processor will proceed to a step 102 and compute the output value, $z_k$, for each node in the hidden layer 84. The output value $z_k$ is preferably computed as the hyperbolic tangent function of the variable "t" expressed as:

$$z_k=(e^t-e^{-t})/(e^t+e^{-t})$$

$$\text{wherein } t=\sum_{m=1}^{12\ 16} w_{km}x_m+b_k\ .$$

$z_k$ output of the $k^{th}$ node in the hidden layer, k=1 . . . 10, $x_m$=$m^{th}$ input node value wherein m=1 . . . 12, $w_{km}$=connection weight for the $k^{th}$ interpolation layer node connected to the $m^{th}$ input node; and $b_k$=bias for $k^{th}$ hidden layer node.

The processor now proceeds to a step 104 and computes a local error $\theta_k$ for each hidden layer node connection to the $m^{th}$ input node according to the formula:

$$\theta_k=(1+z_k)*(1-z_k)*(\Theta*w_k),$$

where, Θ is either an initially assigned value from step 92 or a value calculated from a previous processing of the training data;

and $w_k$=connection weight for $k^{th}$ hidden node connection to the $m^{th}$ input node.

The processor proceeds to step 106 and updates the weights of the connections between the input nodes and the hidden layer nodes as follows:

$$w_{km,new}=w_{km,old}+\Delta w_{km,old},$$

$$\Delta w_{km,old}=\gamma\theta_{k,new}x_m$$

where,

γ is the scalar learning rate factor either initially assigned in step 94 or further assigned after certain further processing of the training data;

$\theta_{k,new}$ is the scaled local error for the $k^{th}$ hidden node calculated in step 104; and $x_m$ is the $m^{th}$ input node value.

The processor next proceeds to step 108 and updates each bias $b_k$ as follows:

$$b_{k,new}=b_{k,old}+\gamma\theta_{k,new}.$$

The processor now proceeds to a step 110 to compute the output from the single output node 80. This output node value, y, is computed as a hyperbolic tangent function of the variable "v" expressed as follows:

$$y=(e^v-e^{-v})/(e^v+e^{-v})$$

$$\text{where } v=\sum_{k=1}^{10} w_k z_k+b_0$$

where $z_k$=hidden node value, k=1,2, . . . 10;

$w_k$=connection weight for the connection of the output node to the $k^{th}$ hidden node; and $b_0$=bias for output node.

The computed value of "y" is stored as the "$n^{th}$" computed output of the output node for the "$n^{th}$" set of processed training data. This value will be hereinafter referred to as "$y_n$". It is to be noted that the value of coil cleanliness for the "$n^{th}$" set of training data is also stored as "$Y_n$" so that there will be both a computed output "$y_n$" and a known output "$Y_n$" for each set of training data that has been processed. As has been previously discussed, the known value of cleanliness is preferably stored in association with the particular set of training data in the disc storage device 74. This allows the known value of coil cleanliness to be accessed and stored as "$Y_n$" when the particular set of training data is processed.

The processor proceeds in a step 112 to calculate the local error Θ at the output layer as follows:

$$\Theta=(y-Y)\cdot(1+y)\cdot(1-y)$$

The processor proceeds to step 114 and updates the weight of the hidden node connections, $w_k$, to the output node using the back propagation learning rule as follows:

$$w_{k,new}=w_{k,old}+\Delta w_{k,old},$$

$$\Delta w_{k,old}=\Gamma\Theta_{new}z_k,$$

where

Γ is the scalar learning factor either initially assigned in step 94 or further assigned after certain further processing of the training data, $\Theta_{new}$ is the local error calculated in step 112, $z_k$ is the hidden node value of the $k^{th}$ node.

The processor next updates the bias $b_o$, in a step 116 as follows:

$$b_{0,new}=b_{0,old}+\Gamma\Theta_{new}.$$

The processor now proceeds to inquire in a step 118 as to whether "N" sets of training data have been processed. This is a matter of checking the indexed count of the read sets of training data established in step 100. In the event that further sets of training data are to be processed, the processor will proceed back to step 96 and again read a set of training data and store the same as the current "$x_m$" input node values. The indexed count of the thus read set of data will be incremented in step 100. It is to be appreciated that the processor will repetitively execute steps 96 through 118 until all "N" sets of training data have been processed. This is determined by checking the indexed count of training data sets that have been read in steps 98. It is also to be appreciated that the "N" sets of training data that are referred to herein as being processed will either be all or a large portion of the total number of sets of training data originally stored in the storage device 74. These "N" sets of training data will be appropriately stored in addressable storage locations within the storage device so that the next set can be accessed each time the indexed count of training data sets is incremented from the first count to the "$N^{th}$" count. When all "N" training data sets have been processed, the processor will reset the indexed count of the read set of training data in a step 120. The processor will thereafter proceed to a step 122 and compute the RMS Error between the cleanliness coil values "$y_n$" computed and stored in step 110 and the corresponding known values "$Y_n$" of coil cleanliness for the set of processed training data producing such computed coil cleanliness as follows:

$$RMS\text{ error}=\left[\left(\sum_{n=1}^{N}(y_n-Y_n)^2\right)/N\right]^{-1/2}$$

Inquiry is made in step 124 as to whether the calculated RMS Error value computed in step 122 is less than a threshold value of preferably 0.001. When the RMS Error is not less than this particular threshold, the processor will proceed along the no path to a step 126 and decrease the respective values of the learning rates γ and Γ. These values may be decreased in increments of one tenth of their previously assigned values.

The processor proceeds to again process the "N" sets of training data, performing the computations of steps 96 through 126 before again inquiring as to whether the newly computed RMS error is less than the threshold of "0.001". It is to be appreciated that at some point the computed RMS error will be less than this threshold. This will prompt the processor to proceed to a step 128 and store all computed connection weights and all final bias values for each node in the hidden layer 84 and the single output node 80. As will now be explained, these stored values are to be used during a run time mode of operation of the processor to compute coil cleanliness values for the outdoor heat exchanger coil of condenser 10 within the refrigeration circuit "A".

Figure 6:
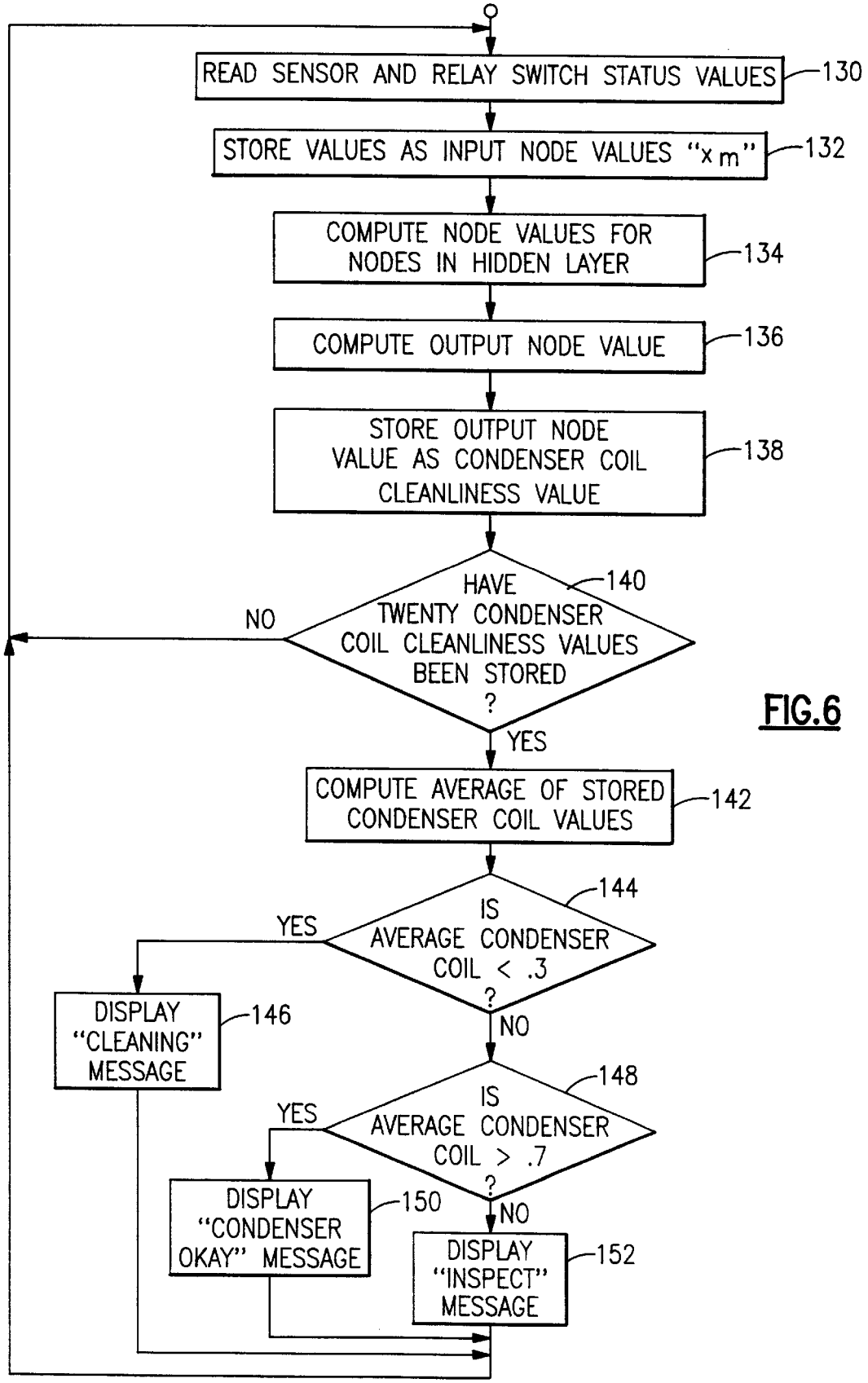
FIG. 6 is a flow chart of a neural-network process executed by the processor of FIG. 2 using the nodes of FIG. 3 during a run time mode of operation.

Referring to FIG. 6, the run time mode of operation of the processor 44 begins with a step 130 wherein sensor values and relay switch status values will be read. In this regard, the processor will await an indication from the controller 40 of the chiller that a new set of sensor values have been read by the controller 40 and stored for use by both the controller and the processor. This occurs periodically as a result of the controller collecting and storing the information from these sensors each time a predetermined period of time elapses. The period of time is preferably set at three minutes. The processor will read these sensor values and the commanded statuses to the relay switches from the controller and store these values as input node values "$x_1 \ldots x_{12}$" in step 132.

The processor proceeds to step 134 and computes the output values, $z_k$, for the ten respective nodes in the hidden layer 84. Each output value $z_k$, is computed as the hyperbolic tangent function of the variable "t" as follows:

$$z_k=(e^t-e^{-t})/(e^t+e^{-t})$$

$$\text{wherein } t=\sum_{m=1}^{12}{}^{16}\, w_{km}x_m+b_k).$$

$x_m$=$m^{th}$ input node value wherein m=1 . . . 12, $w_{km}$=connection weight for the $k^{th}$ interpolation layer node connected to the $m^{th}$ input node; and $b_k$=bias for $k^{th}$ hidden layer node.

The processor proceeds from step 134 to step 136 wherein an output node value "y" is computed as a hyperbolic tangent function of the variable "v" expressed as follows:

$$y=(e^v-e^{-v})/(e^v+e^{-v})$$

$$\text{where } v=\sum_{k=1}^{10} w_kz_k+b_0$$

where $z_k$=hidden node value, k=1,2, . . . 10;

$w_k$=connection weight for the output node connected to $k^{th}$ hidden node; and $b_0$=bias for output node.

The processor now proceeds to a step 138 and stores the calculated value, "y", of the output node as a condenser coil cleanliness value. Inquiry is next made in step 140 as to whether twenty separate condenser coil cleanliness values have been stored in step 138. In the event that twenty values have not been stored, the processor will proceed back to step 130 and read the next set of sensor values and commanded relay switch status values. As has been previously noted, the next set of sensor values and commanded relay switch status values will be made available to the processor following a timed periodic reading of the sensors by the controller 40. This timed periodic reading by the controller is preferably every three minutes. These new readings will be immediately read by the processor 44 and the computational steps 132 through 136 will again be performed thereby allowing the processor to again store another value of computed coil cleanliness in step 138. It is to be appreciated that at some point in time, the processor will have noted in step 140 that twenty separate sets of sensor values and relay switch status value will have been processed. This will prompt the processor to proceed to a step 142 where the average of all estimated coil cleanliness values stored in step 138 will be computed. The processor will proceed in step 144 to compare the computed average coil cleanliness value with a coil cleanliness value of "0.3". In the event that the average coil cleanliness value is less than "0.3", the processor will proceed to a step 146 and display a message preferably indicating that outdoor coil of condenser 10 needs cleaning. This display preferably appears on the display 70 of the control panel. In the event that the average cleanliness value is equal to or greater than "0.3", then the processor will proceed to a step 148. Inquiry is made in step 148 as to whether the average coil cleanliness value is greater than "0.7". In the event that the answer to this inquiry is yes, then the processor will proceed to a step 150 and display a message preferably indicating that the condenser coil is okay. The processor will otherwise proceed to a step 152 in the event that the average computed cleanliness value is equal to or less than 0.7 and display a message indicating that the coil of the condenser 10 should be inspected at the next servicing.

Referring to display steps 146, 150 or 152, the processor will exit from the display of one of the noted messages and return to step 130. The processor will again read a new set of sensor and commanded relay switch status values in step 130. These values will be stored into the memory of the processor 44 when indicated as being available from the controller 40. The processor will ultimately compute twenty new coil cleanliness values. Each of these newly computed values will replace a previously stored coil cleanliness value in the processor's memory that had been computed for the previous averaging of stored coil cleanliness values. The processor will thereafter compute a new average coil cleanliness value sixty minutes from the previously computed coil cleanliness values. In this regard, the processor will have successively read and processed twenty new sets of sensor and relay switch information each set being successively read in three minute intervals. The newly displayed average coil cleanliness value will result in one of the three messages of steps 146, 150 and 152 being displayed on the display 70.

It is to be appreciated from the above that a displayed message of coil cleanliness is made on an on-going basis. These message are based on averaging the computed level of cleanliness of the outdoor coil of condenser 10 in the chiller system in FIG. 1. These computed level of coil cleanliness will lie in the range of "0.1" to "0.9" and will be in granulated increments of at least "0.1". As a result of this computation and resulting visual displays of cleanliness information, any operator of the chiller system can note when a problem is occurring with respect to the level of coil cleanliness and take appropriate action.

It is to be appreciated that a particular embodiment of the invention has been described. Alterations, modifications and improvements may readily occur to those skilled in the art. For example, the processor could be programmed to timely read input data without relying on the controller. The sensed conditions within the chiller could also be varied with potentially less or more values being used to define the neural-network values during development. These same values would ultimately be used to compute coil cleanliness values during the run time mode of operation. Accordingly, the foregoing description is by way of example only and the invention is to be limited by the following claims and equivalents thereto:

What is claimed is:

1. A process for monitoring the condition of an outdoor heat exchange coil in a heating or cooling system comprising the steps of:

reading values of information concerning certain operating conditions of the heating or cooling system wherein at least some of the values are produced by sources of information located within the heating or cooling system;

processing the read values of information concerning the operating conditions of the heating or cooling system through a neural network so as to produce a computed indication of the condition of the outdoor heat exchange coil that is based on having processed the read values through the neural network;

comparing the computed indication of the condition of the outdoor heat exchange coil with at least one predetermined value for the condition of the outdoor heat exchange coil of the heating or cooling system; and transmitting a status message as to the condition of the outdoor heat exchange coil in response to said step of comparing the computed indication of the condition of the outdoor heat exchange coil with at least one predetermined value for the condition of the outdoor heat exchange coil.

2. The process of claim 1 wherein the neural network comprises a layer of input nodes, each input node receiving a value of information concerning a certain operating condition of the heating or cooling system and wherein the neural network further comprises a layer of hidden nodes wherein each hidden node is connected to the input nodes through weighted connections that have been previously learned by the neural network, said process further comprising the step of:

computing values at each hidden node based upon the values of the weighted connections of each hidden node to the input nodes in the input layer.

3. The process of claim 2 wherein the neural network further comprises at least one output node that is connected to each hidden node through weighted connections that have been previously learned by the neural network, said process further comprising the step of:

computing an indication of the condition of the outdoor heat exchange coil based upon both the values of the weighted connections of the output node to each hidden node and the computed values of each hidden node.

4. The process of claim 1 wherein the at least one predetermined value for the condition of the outdoor heat exchange coil comprises a value above which any computed indication of the condition of the heat exchanger coil is deemed to indicate a clean heat exchanger coil in the transmitted status message.

5. The process of claim 4 wherein there is at least a second predetermined value for the condition of the outdoor heat exchange coil below which any computed indication of the condition of the heat exchanger is deemed to be a dirty heat exchanger coil in the transmitted status message.

6. The process of claim 1 wherein the neural network has previously learned neural network values for at least two conditions of the outdoor heat exchange coil wherein one of the conditions is for a substantially clean coil and the second condition is for a substantially dirty coil with degraded heat exchange performance, and wherein said step of processing the read values of information concerning the operating conditions of the heating or cooling system comprises the step of:

interpolating between the previously learned neural network values for the two conditions of the outdoor heat exchange coil so as to produce an indication of the condition of the outdoor heat exchange coil for the read values of the sensed conditions occurring in the heating or cooling system.

7. The process of claim 1 wherein said heating or cooling system includes a refrigeration circuit having at least one heat exchanger in the refrigeration circuit, the heat exchanger having the outdoor heat exchange coil that is being monitored and wherein said step of reading values of information concerning certain operating conditions of the heating or cooling system comprises the step of:

reading the value of at least one piece of information concerning the operation of the heat exchanger in the refrigeration circuit of the heating or cooling system.

8. The process of claim 7 wherein said step of reading the value of at least one piece of information concerning the operation of the heat exchanger in the refrigeration circuit of the heating or cooling system comprises the steps of:

reading the temperature of air before entering the heat exchanger; and reading the temperature of the air leaving the heat exchanger.

9. The process of claim 7 wherein said step of reading the value of at least one sensed piece of information concerning the operation of the heat exchanger in the heating or cooling system comprises the steps of:

reading the temperature of the refrigerant before entering the heat exchanger; and reading the temperature of the refrigerant leaving the heat exchanger.

10. The process of claim 7 wherein said step of reading the value of at least one piece of information concerning the operation of the heat exchanger in the heating or cooling system comprises the steps of:

reading the status of a set of fans associated with the heat exchanger.

11. The process of claim 10 wherein said step of reading values of information concerning certain operating conditions of the heating or cooling system comprises the step of:

reading the value of at least one sensed temperature condition of the refrigerant downstream of the heat exchanger and upstream of an expansion valve in the refrigeration circuit of the heating or cooling system.

12. The process of claim 7 wherein the heating or cooling system comprises at least two refrigeration circuits each of which includes a respective heat exchanger and wherein said step of reading values of certain conditions occurring in the heating or cooling system comprises the step of:

reading the values of a plurality of operating conditions for the second heat exchanger in the second refrigeration circuit in the heating or cooling system.

13. The process of claim 12 wherein said step of reading a plurality of operating conditions for the second heat exchanger further comprises the steps of:

reading the temperature of the refrigerant in the second refrigeration circuit before entering the second heat exchanger; and reading the temperature of the refrigerant in the second refrigeration circuit leaving the second heat exchanger.

14. The process of claim 13 wherein said step of reading a plurality of conditions occurring with respect to the second heat exchanger further comprises the steps of:

reading the status of a set of fans associated with the second heat exchanger.

15. The process of claim 11 wherein said step of reading values of certain operating conditions of the heating or cooling system comprises the step of:

reading the value of at least one sensed temperature condition of the refrigerant downstream of the second heat exchanger and upstream of an expansion valve in the second refrigeration circuit of the heating or cooling system.

16. A process for learning the characteristics of a heating or cooling system so as to predict the condition of an outdoor heat exchange coil in the heating or cooling system, said process comprising the steps of:

storing a plurality of sets of data in a storage device for certain operating conditions of the heating or cooling system when the system is subjected to various load and ambient conditions for various known conditions of the outdoor heat exchange coil; and repetitively processing a number of the stored sets of data through a neural network residing in a processor associated with the storage device so as to teach the neural network to accurately compute indications for at least two known conditions of the outdoor heat exchange coil for the particular sets of data whereby the neural network may be used thereafter to process data for operating conditions of the heating or cooling system wherein the condition of the outdoor heat exchange coil is unknown so as to produce a computed indication of the condition of the heat exchange coil.

17. The process of claim 16 wherein the neural network comprises a plurality of input nodes in a first layer, a plurality of hidden nodes in a second layer wherein the hidden nodes in the second layer have weighted connections to the input nodes in the first layer and at least one output node for computing the indication of the condition of the outdoor heat exchange coil, the output node having weighted connections to the hidden nodes in the second layer.

18. The process of claim 17 further comprising the step of:

adjusting the weighted connections between the input nodes of the first layer and the hidden nodes in the second layer in response to the repetitive processing of the number of stored sets of data; and adjusting the weighted connections between the hidden nodes of the second layer and the output node in response to the repetitive processing of the number of stored sets of data; and computing indications as to the condition of the outdoor heat exchange coil at the output node based on the adjusted weighted connections between input nodes and hidden nodes and adjusted weighted connections between hidden nodes and output nodes whereby the adjusted weighted connections between all nodes eventually produce computed indications as to the condition of the outdoor heat exchange coil that converge to the indications for the known conditions of the outdoor heat exchange coil for the sets of data being respectively processed through the neural network.

19. The process of claim 16 wherein the two known conditions of the outdoor heat exchange coil comprise a first condition wherein the heat exchanger coil is substantially clean and a second condition wherein the heat exchanger coil is substantially dirty with a degraded heat exchange performance relative to a heat exchanger coil in the substantially clean condition wherein each known condition has an assigned mathematical value.

20. The process of claim 17 wherein said step of storing a plurality of sets of data for certain operating conditions of the heating or cooling system comprises the steps of:

storing at least a portion of each set of data as a plurality of values representing sensed values generated by sensors within the heating or cooling system for a known condition of the outdoor heat exchange coil; and storing a value indicative of the known condition of the outdoor heat exchange coil in association with the set of data containing these particularly sensed values whereby the value indicative of the known condition of the outdoor heat exchange coil can be later associated with the set of data.

21. The process of claim 20 wherein said step of repetitively processing a number of the stored sets of data comprises the steps of:

reading a set of data;

adjusting the weighted connections between the input nodes of the first layer and the hidden nodes in the second layer in response to the read set of data; and adjusting the weighted connections between the hidden nodes of the second layer and the output node in response to the read set of data whereby the adjusted connections between all nodes eventually produce a computed indication of the condition of the outdoor heat exchange coil that converges to the known values indicative of the condition of the outdoor heat exchange coil for the sets of data being repetitively processed.

22. The process of claim 16 wherein said step of storing a plurality of sets of data for certain conditions occurring within the heating or cooling system comprises the steps of:

storing at least a portion of each set of data as a plurality of values representing sensed values generated by sensors within the heating or cooling system for a known condition of the outdoor heat exchange coil; and storing an indication as to the known condition of the outdoor heat exchange coil that was present in the heating or cooling system when the sensors generated the particular set of values in association with the respective set of stored data whereby the indications to the known condition of the outdoor heat exchange coil can be associated with the respective stored set of data.

23. The process of claim 22 wherein said step of storing at least a portion of each set of data as a plurality of values representing values generated by sensors within the heating or cooling system comprises the steps of:

storing at least one sensed value generated by a sensor measuring the temperature of air before entering the heat exchanger coil within the heating or cooling system; and storing at least one sensed value generated by a sensor measuring the temperature of air leaving the heat exchanger coil within the heating or cooling system.

24. The process of claim 22 wherein said step of storing at least a portion of each set of data as a plurality of values representing values generated by sensors within the heating or cooling system comprises the steps of:

storing at least one value generated by a sensor measuring the temperature of a refrigerant entering the heat exchanger coil within the heating or cooling system; and storing at least one value generated by a sensor measuring the temperature of the refrigerant leaving the heat exchanger coil within the heating or cooling system.

25. The process of claim 24 wherein said step of storing a plurality of sets of data for certain operating conditions of the heating or cooling system comprises the steps of:

storing at least one value within each set of data indicating the status of a set of fans associated with the heat exchanger coil within the heating or cooling system.

26. A process for monitoring the condition of the outdoor heat exchange coil of a heating or cooling system comprising the steps of:

repetitively reading values of certain sensed conditions produced by a plurality of sources of information within the heating or cooling system;

storing each set of read values in a plurality of input nodes in a neural network;

processing each stored set of values through a hidden layer of nodes and an output layer consisting of least one output node whereby a computed value as to the condition of the outdoor heat exchange coil is produced at the output node for each stored set of read values;

storing each computed value as to the condition of the outdoor heat exchange coil produced at the output node for each set of values processed through the neural network; and computing an average of the stored computed values as to the condition of the outdoor heat exchange coil after a predetermined number of computed values as to the condition of the outdoor heat exchange coil have been produced at the output node.

27. The process of claim 26 further comprising the step of:

comparing the computed average of the stored computed values as to the condition of the outdoor heat exchange coil with at least one predetermined value for the condition of the outdoor heat exchange coil within the heating or cooling system; and generating a message when the computed average of the stored computed values as to the condition of the outdoor heat exchange coil is below the at least one predetermined value for the condition of the outdoor heat exchange coil.

28. The process of claim 27 further comprising the step of:

comparing the computed average of the stored computed values as to the condition of the outdoor heat exchange coil with at least a second predetermined value of the condition of the outdoor heat exchange coil; and generating a message when the computed average of the stored computed values as to the condition of the outdoor heat exchange coil is above the second predetermined value of the condition of the outdoor heat exchange coil.

29. The process of claim 26 further comprising the step of:

repeating said steps of repetitively reading values of certain conditions, storing each set of read values, and processing each stored set of read values through the neural network whereby a new computed value as to the condition of the outdoor heat exchange coil is produced for each processed set of read values; and storing each new computed value as to the condition of the outdoor heat exchange coil for each processed set of values; and computing an average of the stored new computed values as to the condition of the outdoor heat exchange coil.

30. The process of claim 29 wherein the neural network comprises a first layer of input nodes, a second layer of hidden nodes and a third layer containing at least one output node wherein each hidden node is connected to the input nodes in the first layer through weighted connections that have been previously learned by the neural network and wherein each hidden node is connected to at least one output through weighted connections that have been previously learned by the neural network, said process further comprising the steps of:

computing values at each hidden node based upon the values of the weighted connections of each hidden node to the input nodes in the first layer; and computing an output value of the condition of the outdoor heat exchange coil at the output node based upon the values of the weighted connections of the output node to each hidden node and the computed values of each of the hidden nodes.

31. The process of claim 30 wherein the weighted connections between the hidden nodes and the input nodes and the weighted connections between the hidden nodes and the output nodes have been learned by the neural network during a development phase in which training data for particular known conditions of the outdoor heat exchange coil were processed through the neural network.

32. The process of claim 31 wherein the particular known conditions of the outdoor heat exchange coil are a condition wherein the heat exchanger coil is substantially clean and a condition wherein the heat exchanger coil is substantially dirty so as to have a substantially degraded heat exchange capability relative to the substantially clean coil.

* * * * *